US006279478B1

(12) United States Patent
Ringer et al.

(10) Patent No.: US 6,279,478 B1
(45) Date of Patent: Aug. 28, 2001

(54) IMAGING-INFRARED SKEWED-CONE FUZE

(76) Inventors: Hayden N. Ringer, 129-C Avenida Majorca, Laguna Hills, CA (US) 92653; Abraham Shrekenhamer, 5007 College View Ave., Los Angeles, CA (US) 90041

( * ) Notice: Subject to any disclaimer, the term of this patent is extended or adjusted under 35 U.S.C. 154(b) by 0 days.

(21) Appl. No.: 09/049,360

(22) Filed: Mar. 27, 1998

(51) Int. Cl.[7] ..... F42C 15/00; F41G 7/22

(52) U.S. Cl. ..... 102/213; 102/213; 102/211; 102/214; 102/384; 244/3.15; 244/3.16; 244/3.19; 244/3.22; 342/62; 342/68

(58) Field of Search ..... 102/213, 214, 102/211, 384; 244/3.15, 3.19, 3.16; 342/62, 68

(56) References Cited

U.S. PATENT DOCUMENTS

| | | | | |
|---|---|---|---|---|
| 3,046,892 | | 7/1962 | Cosse et al. . | |
| 3,242,339 | | 3/1966 | Lee . | |
| 3,942,446 | | 3/1976 | Cruzan . | |
| 4,168,663 | | 9/1979 | Kohler . | |
| 4,203,366 | | 5/1980 | Wilkes . | |
| 4,599,616 | | 7/1986 | Barbella et al. . | |
| 4,625,647 | | 12/1986 | Laures . | |
| 4,627,351 | | 12/1986 | Thordarson et al. . | |
| 4,630,050 | | 12/1986 | Johnson . | |
| 4,895,075 | | 1/1990 | Munzel . | |
| 5,669,581 | * | 9/1997 | Ringer | 244/3.16 |
| 5,696,347 | * | 12/1997 | Sebeny | 102/214 |
| 5,964,432 | * | 10/1999 | Obkircher | 244/3.16 |

* cited by examiner

*Primary Examiner*—Charles T. Jordan
*Assistant Examiner*—Lulit Semunegus

(57) ABSTRACT

A fuzing system for non-spinning or substantially non-spinning weapons is implemented by means of wide angle optics providing at least forward-hemisphere coverage, an array of infrared detectors and a microprocessor for image and data processing, aim-point selection, directional-warhead aiming and skewed-cone fuzing. The skewed-cone fuzing has a generatrix which is the vector sum of missile velocity, warhead velocity and the negative of target velocity.

14 Claims, 7 Drawing Sheets

IMAGING-INFRARED SKEWED-CONE FUZE

BACKGROUND OF THE INVENTION

1. Field of the Invention

The field of this invention is generally target fuzing and specifically air-target fuzing, although many types of surface targets can be served, too. The invention also relates to the fields of: (1) Air-Targets-Aircraft, Helos, Missiles, RV's and RPV's; (2) WideAngle, Body-Fixed, and Passive Imaging-infrared Sensing and Target Detection Devices; (3) Skewed-Cone Fuzing with Aim-Point Selection and Directional-Warhead aiming; and (4) Non-Spinning or Slowly-Spinning weapons.

2. Prior Art

The first anti-aircraft projectile proximity fuze, a radio-frequency-field motion detector. was developed in 1942. It provided very crude target location, literally proximity, based on signal amplitude, and detonated a nearly-omni-directional blast-fragment warhead.

Near the end of World War II, evolving radar and anti-aircraft missile technology combined to produce the fixed-angle microwave fuze. Centimeter-wavelength antennae about the missile periphery created a forward-looking right cone of revolution at a fixed angle about the longitudinal axis. Radar echoes from targets crossing the conical beam detonated a fragmenting warhead somewhat focused normal to the missile's longitudinal axis with an approximate lead time. This degree of target location enabled a few hundred pounds of explosive to kill relatively-slow aircraft at tens of feet.

The hollow-cone sensor actually served two functions. It located the target with fair precision in missile/warhead space, and its shape provided an elegant fire control algorithm. Given a planar fragmenting warhead, i.e., one focused into a tight circumferential spray roughly normal to the missile's longitudinal axis, upon detonation., an expanding ring of fragments flew outward with a velocity $V_w$, and forward with a velocity $V_M$, forming a right cone about the missile's longitudinal axis having a half-angle of $=\tan^{-1} V_w/V_M$, the so-called dynamic fragmentation pattern (see FIG. 1). Now if the fuzing cone were coincident with the dynamic fragment cone, the fire control algorithm was ultimately simple: fire when you saw the target, without regard for miss distance, and the target and fragments each would travel to assured intercept—a truly-elegant, angle-only solution.

Or almost a solution. In actuality, two major sources of fuzing error have been neglected above: (1) the effects of target motion, and (2) the location of the target's so-called center of vulnerability (COV) within the fuze detection surface (generally not the target's physical surface). Note that the target velocity could be taken into account completely if the fuzing cone were skewed by adding $-V_T$, the negative target velocity vector, to $V_M$, to form $V_R$, the relative velocity vector (see FIG. 2). Unfortunately, this proved impractical to do with vacuum tubes and waveguide antennae. (Even variable-angle right cones were found impractical). And no solutions to the COV problem a crude radar or thermal centroiding beyond were offered with an approximate time delay between target detection and firing to permit COV approach.

Thus, the last 50 years of air-target fuzing have been one continuous attempt to compensate a fixed-angle fuze for these two sources of error. (Not to overlook progress in materiel from vacuum tubes to microchips, fuze beam resolution using shorter wavelengths, signaling techniques for improved clutter and counter-measure resistance, etc.). This attempt has centered on tilting the sensing cone forward to permit the use of a fixed time delay based on various built-in estimates or, later, a variable time delay based on fuze, guidance, or fire control observables (target-type, velocity, and heading; long-range line-of-sight (LRLOS), miss distance, miss quadrant, etc.), and adding/dividing sensing cones for additional position/extent fixes.

However, during the last 50 years missile and target speeds have increased, generally more than fragment speeds, so fuzing cones have been pushed forward. At best this means larger time delays to cover all encounters, and larger fuzing errors with incomplete/inaccurate encounter information. Warhead beamwidths have been increased to fill the larger volumes of uncertainty with a consequent reduction in lethality. At worst, it means that in high-speed crossing shots, targets can slide in behind a single fuze cone without being seen! For the next generation of targets, such as RV's, the system of fixed-angle fuzing of planar-fragmenting warheads threatens to break down completely, as in Patriot.

As evidence of the state of the art as reflected in issued U.S. patents, a search of the fuze and related classes has disclosed 10 patents, listed below numerically:

- U.S. Pat. No. 3,046,892 Cosse et al—Spinning Projectile, Optical/Radio Fixed-Angle, Non-Imaging/Non-Centroiding, Planar Warhead.
- U.S. Pat. No. 3,242,339 Lee—Non-Spinning, Multiple-Optical Fixed-Angle, Non-Imaging/Non-Centroiding, (Directional Warhead).
- U.S. Pat. No. 3,942,446 Cruzan—Non-Spinning, Multiple-Optical Fixed-Angle, Non-Imaging/Non-Centroiding, (Directional Warhead).
- U.S. Pat. No. 4,168,663 Kohler—Non-Spinning, Radar Time-To-Go, Non-Imaging/Non-Centroiding, Planar Warhead.
- U.S. Pat. No. 4,203,366 Wilkes—Non-Spinning, Radar Fixed-Angle, Non-Imaging/Non-Centroiding, Planar Warhead.
- U.S. Pat. No. 4,599,616 Barbella et al—Non-Spinning, Radar Fixed-Angle, Non-Imaging/Non-Centroiding, Planar Warhead.
- U.S. Pat. No. 4,625,647 Laures—Non-Spinning, Radar Fixed-Angle, Non-imaging but Centroiding, Planar Warhead.
- U.S. Pat. No. 4,627,351 Thorsdarson et al—Spinning Projectile, Optical/Radar Fixed-Angle, Non-Imaging/Non-Centroiding, Directional Warhead.
- U.S. Pat. No. 4,630,050 Johnson—Non-Spinning, Radar Time-To-Go Seeker-Fuze, Non-Imaging/Non-Centroiding, Planar Warhead.
- U.S. Pat. No. 4,895,075 Munzel—Spinning Projectile, Wide-Angle-Radar Skewed-Cone (Approx.) Non-Imaging/Non-Centroiding, Planar Warhead.

Not one disclosure uses imaging, with all its benefits, including aim-point selection, and only one disclosure (Laures) attempts aim-point selection (by delaying firing after presumed nose (or tail) detection). Only one disclosure (MCinzel) approximates skewed-cone fuzing by happenstance—with a right cone centered on $V_R$ and only three disclosures permit or use a directional warhead.

Analyzing the shortcomings of Fixed-Angle Fuzing to guide the next generation system design, the following is needed: (1) A skewed-cone firing algorithm which conforms to actual (or estimated) target vector velocity, both to increase fuzing accuracy and to preclude blind crossing shots; (2) Target feature recognition to permit aim-point selection and highest kill probability; and (3) A prediction of miss direction to permit high-lethality directional warheads. These features will enable an aimable or steerable warhead to be aimed/steered in the predicted miss direction of the desired target aim point and detonated when said aim point crosses the skewed fuzing cone, resulting in a so-called optimum burst point from which the most fragments will impact the (presumed) most vulnerable portion of the target. One way of satisfying these requirements would be to provide an annular optical sensor or array of sensors projecting the skewed-cone onto a movable ring of detectors as in FIG. 3. The problems of this approach are expense, fragility, and crude, partial and late imaging as the target sweeps past the skewed-cone, requiring imprecise aim-point selection and millisecond warhead aiming.

The preferred way of fulfilling all three of these requirements is by a wide-angle, imaging-infrared sensor in which the skewed-cone algorithm, the aim-point selection, and the miss-direction prediction are accomplished in image-processing software.

SUMMARY OF THE INVENTION

The principal object of this invention is to update air-target fuzing to cope with modern and future threats by: (1) Increasing air-target fuzing accuracy; (2) Increasing air-target fuzing clutter and countermeasures resistance; (3) Enabling the use of smaller but increased-lethality directional warheads against the target's center of vulnerability, thereby permitting smaller missiles or larger motors; (4) Doing the above with compact "universal"/scaleable (and hence lower development and production cost) fuze modules which can be installed flexibly in both old and new missile designs; and (5) Permitting fuzing against surface targets by non-spinning projectiles, multi-mission missiles, or rockets and bombs.

The invention is implemented by means of wide angle optics providing at least forward hemisphere coverage, an array of infrared detectors and a microprocessor for image and data processing, aim-point selection, directional-warhead aiming and skewed-cone fuzing. The skewed-cone fuzing has a generatrix which is the vector sum of missile velocity, warhead velocity and the negative of target velocity. The invention herein is directed to non-spinning or substantially non-spinning weapons (i.e., weapons spinning at less than about thirty revolutions per second).

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which:

FIG. 4, comprising FIG. 5, comprising

DETAILED DESCRIPTION OF A PREFERRED EMBODIMENT

Figure 1:
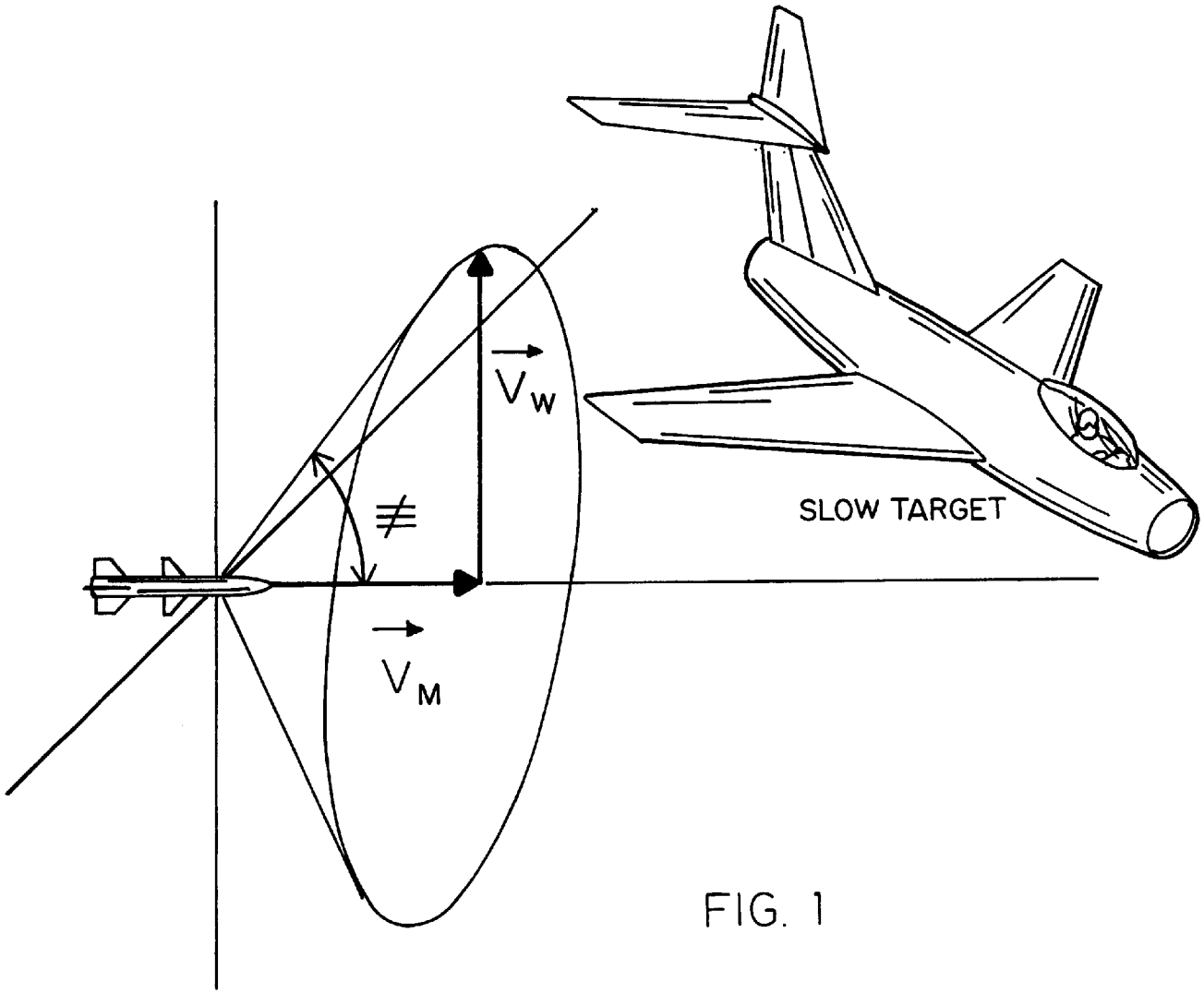
FIG. 1 is a diagram of air-target intercept geometry using fixed-angle fuzing.
Figure 2:
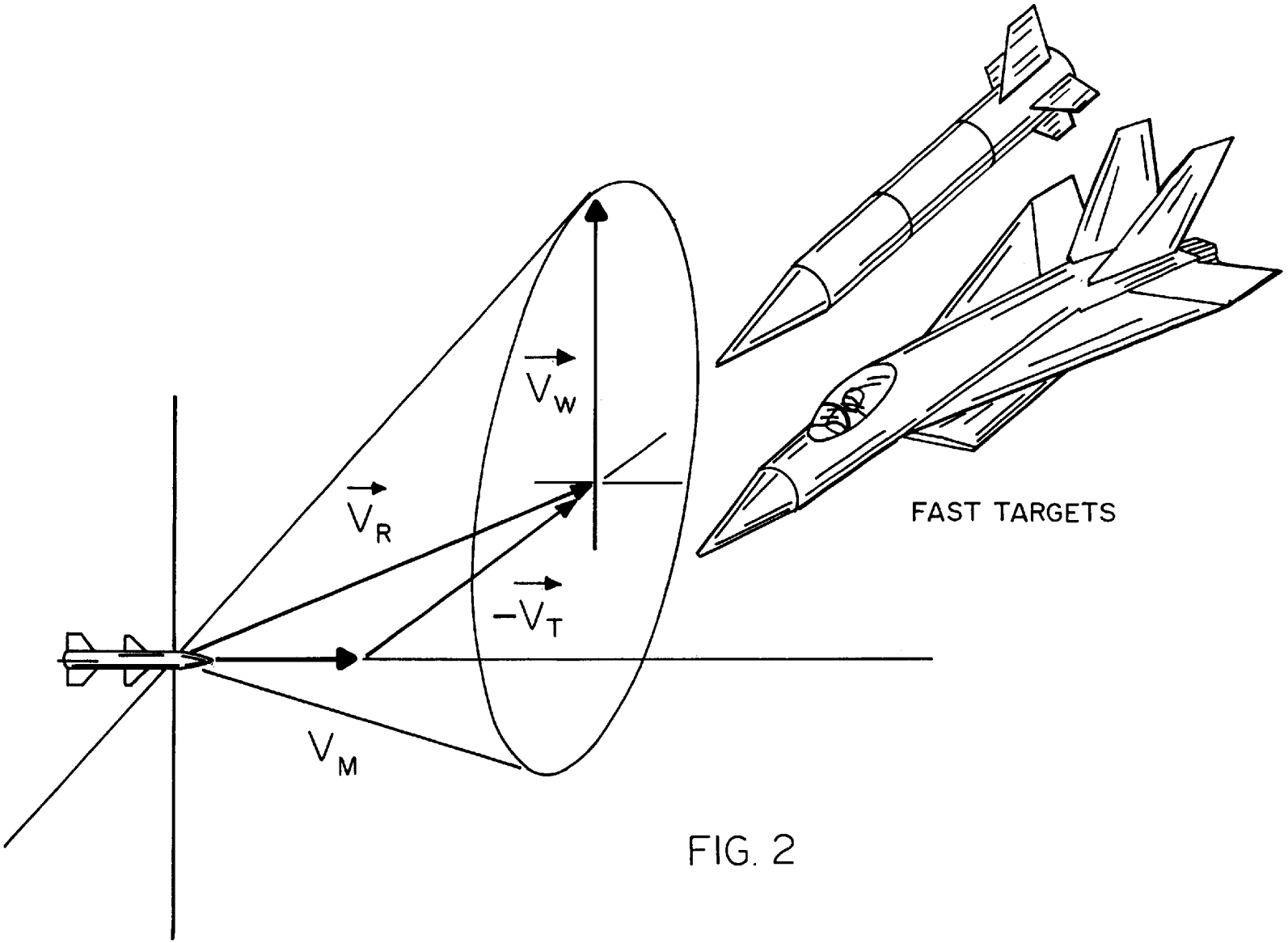
FIG. 2 is a diagram of air-target intercept geometry using skewed-cone fuzing.
Figure 3:
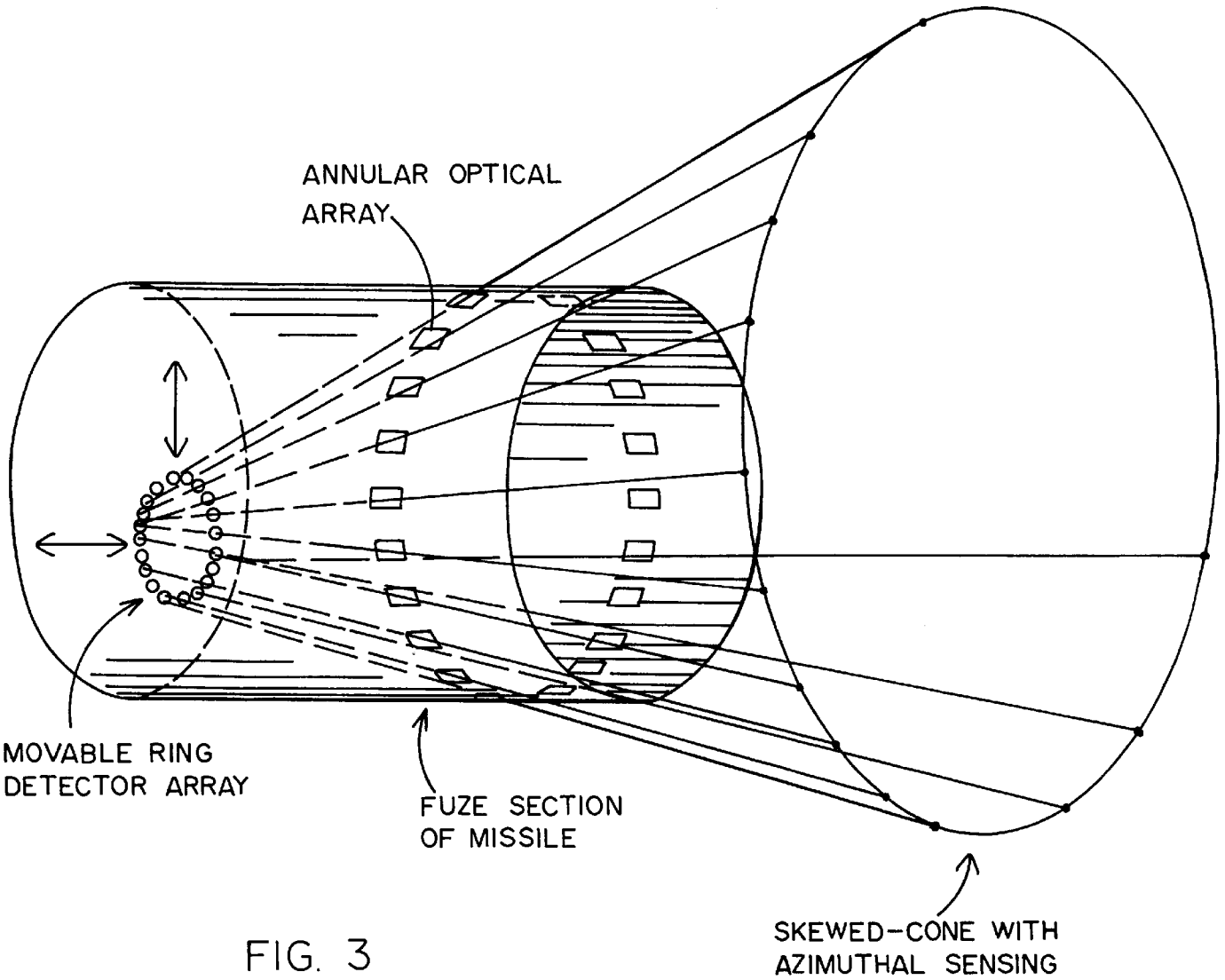
FIG. 3 is a simplified illustration of an optical array and detector array in a fuze section of a missile employing skewed-cone fuzing.
Figure 4B:
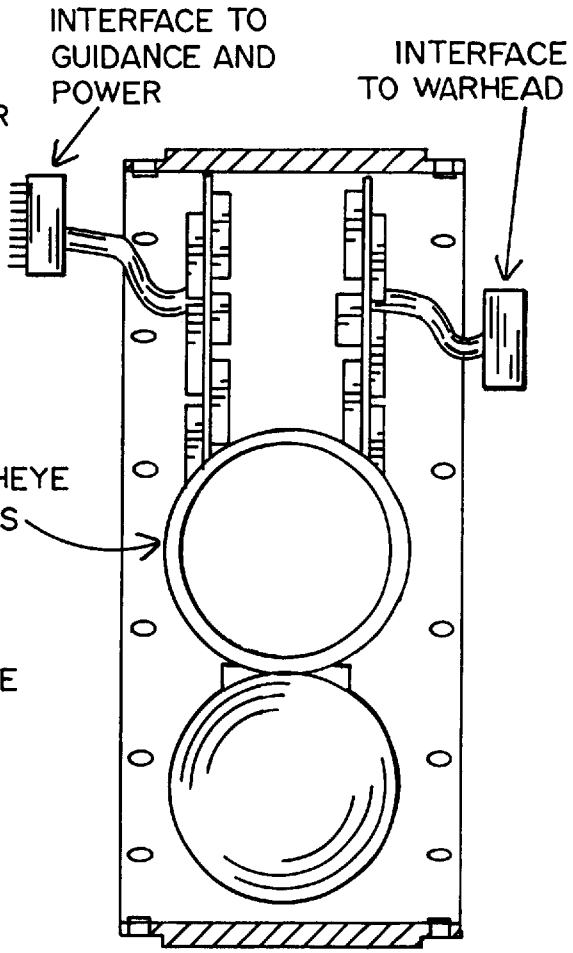
FIGS. 4*a*, 4*b*, 4*c* and 4*d*, is an illustration of a preferred embodiment of the invention.
Figure 4A:
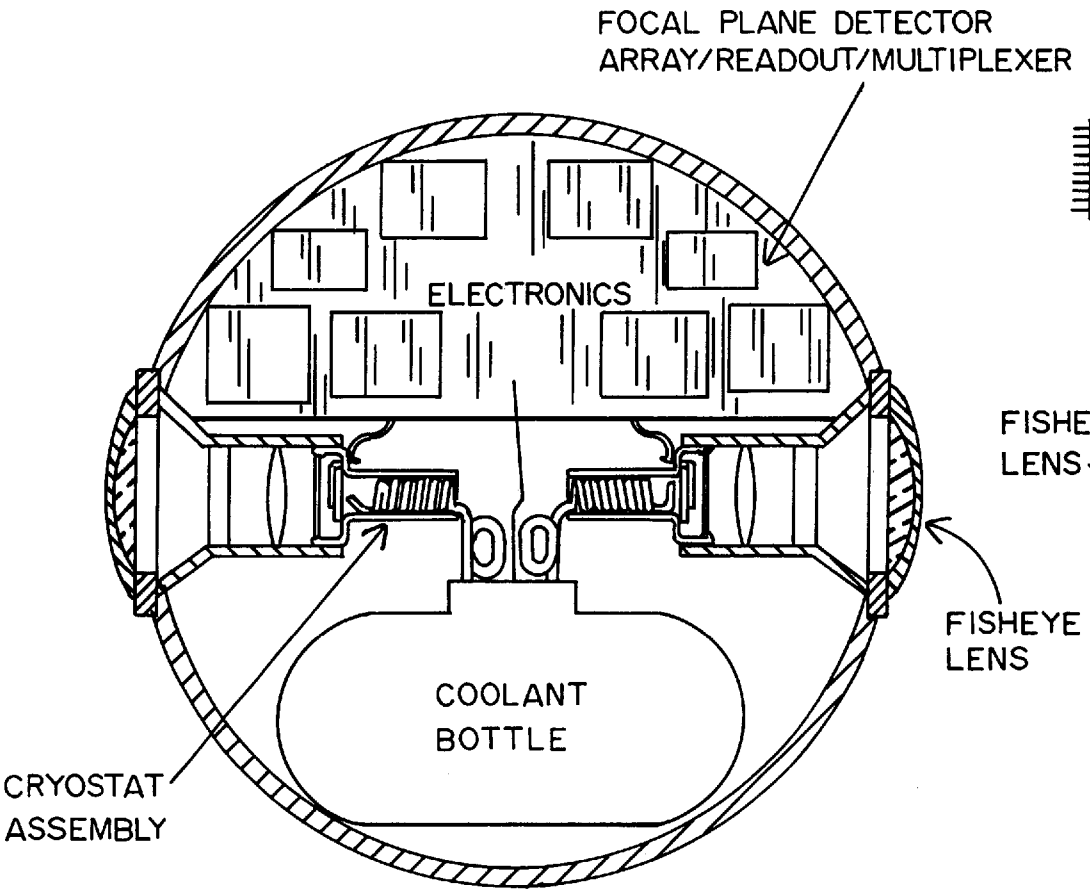
Figure 4C:
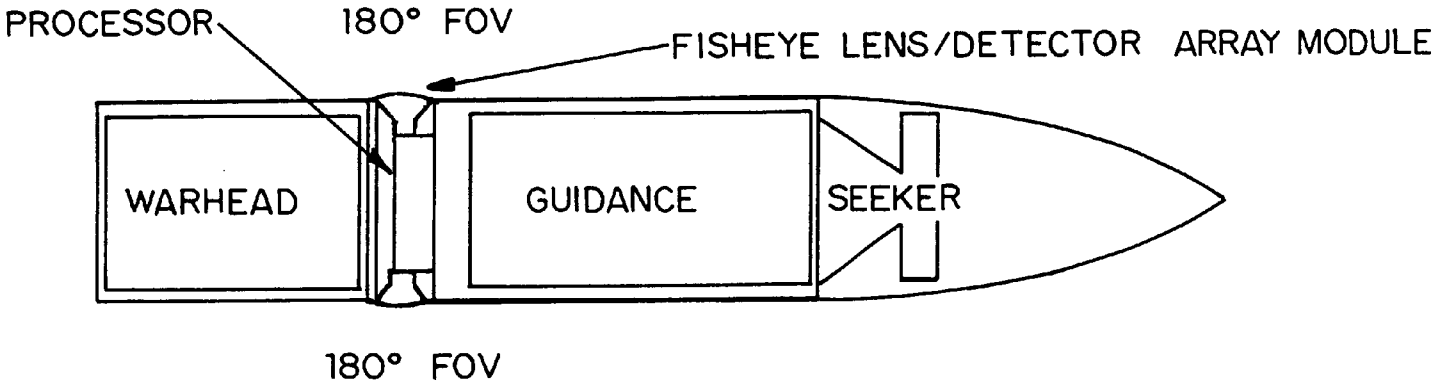
Figure 4D:
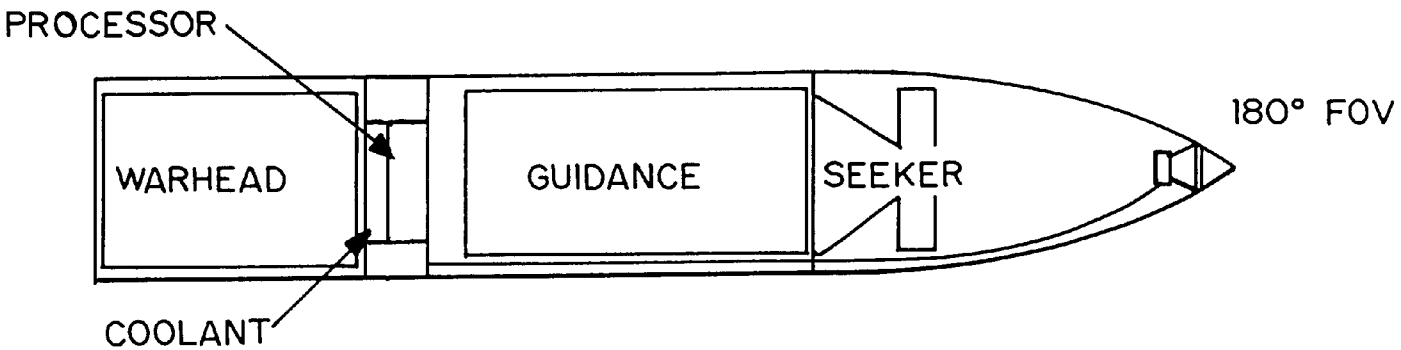
Figure 5A:
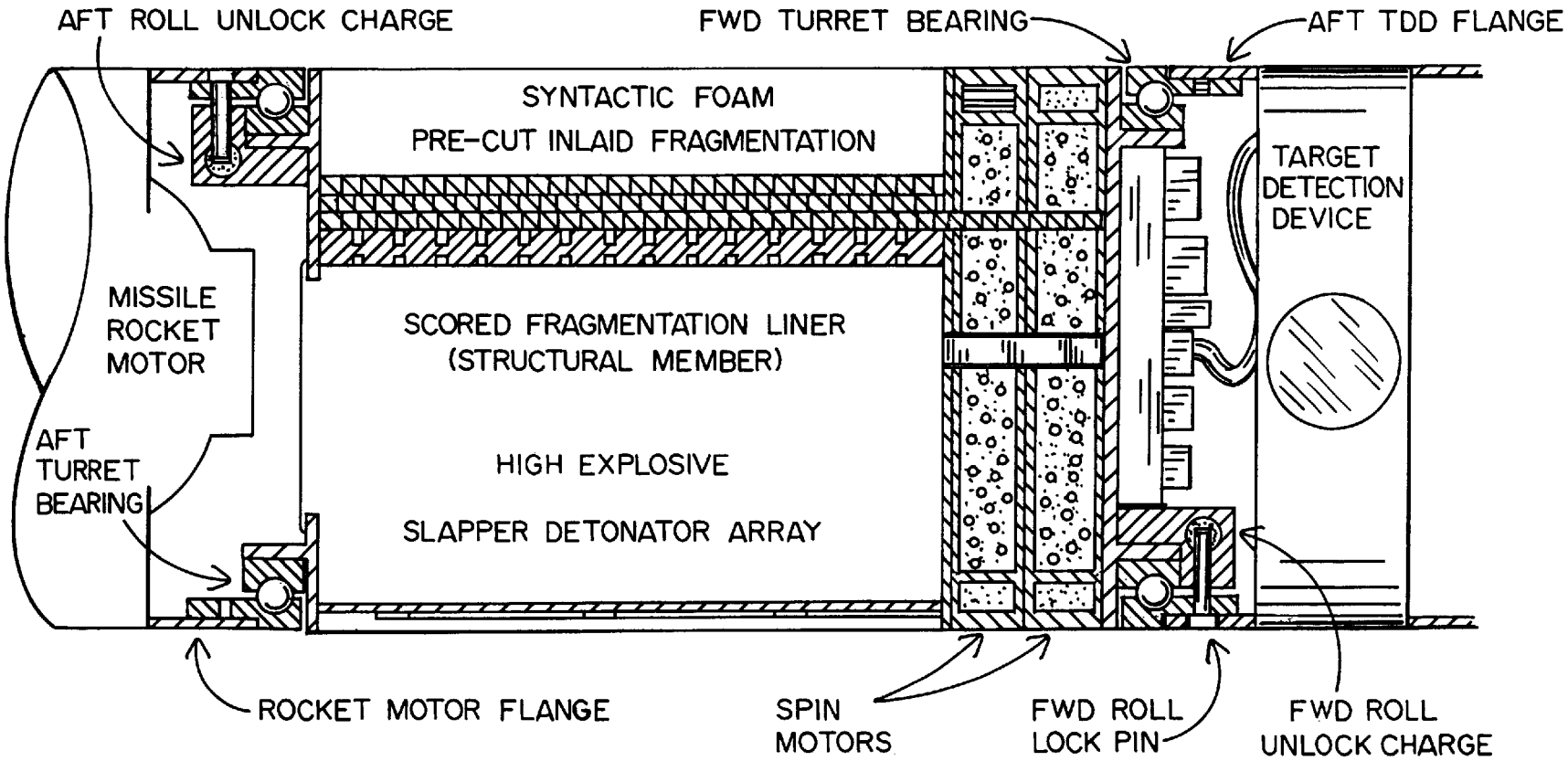
FIGS. 5*a* and 5*b*, illustrates an aimable warhead for use in the invention.
Figure 5B:
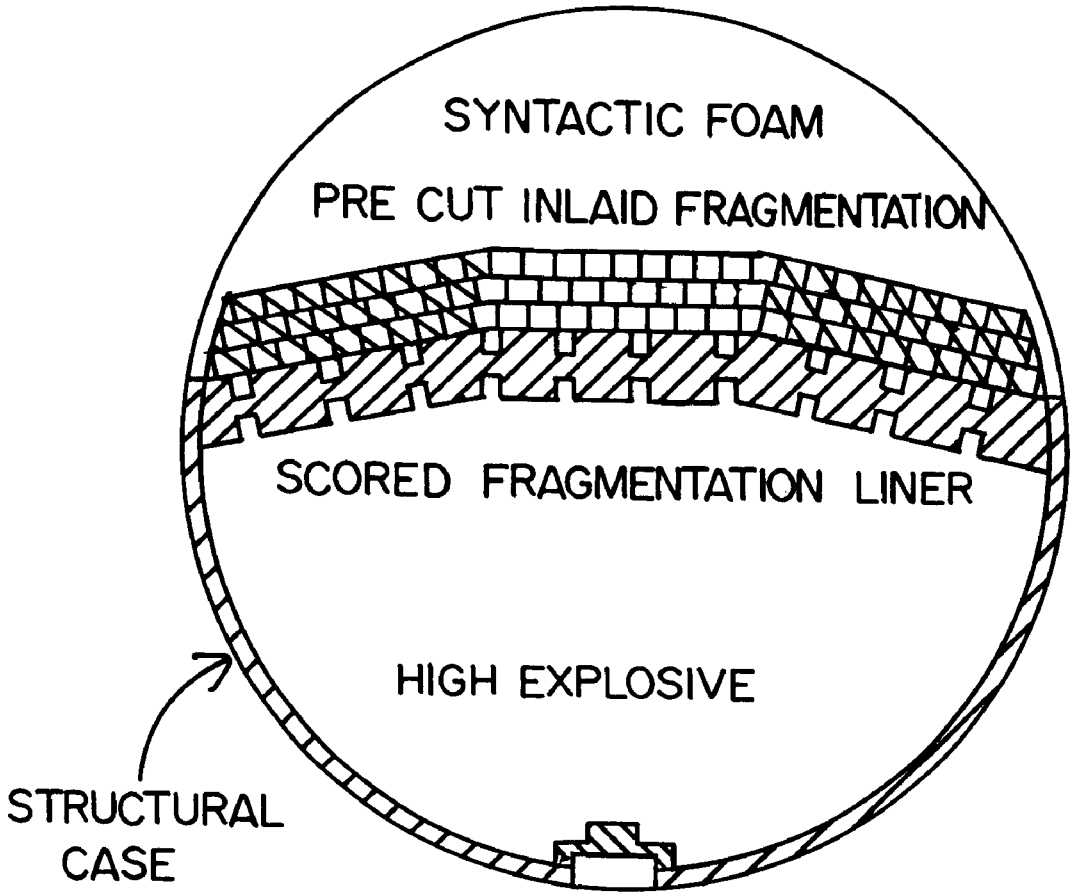

The elements of the preferred embodiment shown in FIGS. 4 and 5, depending on the application, are (1) One or two 180-degree fisheye lenses imaging forward and optionally rearward hemispheres; (2) One or two 64-element infrared detector arrays and associated optics (three-degree resolution); (3) A digital microprocessor; (4) An aimable warhead; and (5) Ancillary devices including power supplies, cooling and safety and arming units.

Sensor

Passive infrared is the medium of choice because it offers sufficient range and resolution even in adverse weather, against expected powered and/or high-speed aero-heated targets, at minimal aperture, hardware and energy costs. The optimum infrared frequency band(s) depend upon the application. The usual clutter and countermeasure problems of passive IR are eliminated by image processing.

Given a place in the nose of the carrier, the invention may comprise either a single body-fixed 180-degree fisheye lens, or a single side-mounted lens rolled to the correct direction by the missile. However, given more-usual locations, aft of the nose, but forward of any control surfaces, two lenses are required, thereby actually imaging the entire spherical surround. Depending upon the particular application, and design and system studies thereof, the forward and rearward hemispheres may be imaged with a 64×64 detector array for each fisheye, or the split forward hemisphere views of the two fisheyes may be conducted by optical fibers or mirrors and combined on a single 64×64 array, or on a 1×64 array scanned by a rapidly-spinning mirror. In any event, it is desirable to achieve a forward hemisphere scan rate of about 1000 frames per second.

Practical considerations here include the use of blow-off covers to protect the lenses during transport, handling, and flight, preferably flush-mounted with pop-out lenses to minimize drag and heating.

Image Processing

Imaging processing provides a series of very powerful logical operations eventually leading to warhead aiming at the target's center of vulnerability and detonation at the optimum burst point. These operations include:

(1) Lens distortion correction, detector response correction, and forward hemisphere image synthesis;

(2) Frame-to-frame image stabilization, with or without missile or fuze rate gyro assistance;

(3) Multi-frame addition for enhanced signal-to-noise;

(4) Subtraction of two such sums to provide stationary background clutter cancellation, and moving target/image growth detection;

(5) Multiple-target track-while-scan and countermeasures (flares, decoys) rejection;

(6) Silhouette reading for aim-point selection: plume editing; nose, tail, and centroid or other aim-point selection. Given VR from the missile seeker, passive ranging by angle rate permits a first-order target classification by target length (and engine count, etc.). (Target type may also be available at the launcher);

(7) Aim-point miss-direction prediction and time-to-go to point-of-closest approach;

(8) Warhead mode selection (focused or wider angle for near misses), focus shaping, and aiming (electronic, electromechanical, pyrotechnic or even missile roll);

(9) Skewed-cone erection by vector addition of current $V_M$ (corrected for missile angle of attack), $-V_T$ (direction of $V_M-V_T$ given by seeker head angle), and $V_w$ (corrected for slowdown, if necessary). If angle of attack is unavailable, not much fuzing error results, since the fuze and warhead beams are locked together. If $V_T$ is unavailable, as in an IR seeker, it may be closely approximated by using the seeker head angle and knowledge of head-on, crossing, or tail chase from silhouette analysis, or it may be known at the launcher;

(10) Optimum Burst Point determination by tracking the selected target aim point into contact with the skewed-cone. Thousands of simulated runs over ranges of all variables indicate an ultimate 1-sigma fuzing error against the selected aim point of 5 percent of the target's length. Of course, given a sufficiently wide-angle image, with sufficiently high resolution, as provided herein, a conventional 3D, two-body (target aim point and a fragment(s)) predictive fire control solution may be calculated using radar/laser or passive optical stadiometric ranging and image growth/range rate on one or more target points, but with more complexity of hardware and/or software than using the skewed cone algorithm.

(11) Fire or hold-fire if a more lethal direct hit impends.

Preliminary estimates based on comparable SADARM processing call for a processor capacity of about 50 MIPS, which with developing circuit densities will occupy on the order of 1 cubic inch of space. This, together with the compact self-contained optics, permits the fuze system modules to be placed almost anywhere in existing missiles as retrofit, or in future missiles, with near-universal, off-the-shelf components—saving substantial costs for development and production.

Warhead

Because of more accurate fuzing and aim-point selection, smaller planar warheads may be used, which means that replacement ordnance packages containing both warhead and fuze are possible.

Still more warhead weight and volume savings may be realized (at a dollar cost) by using directional warheads, making possible smaller payloads and missiles, or larger propulsion sections for a given missile length. One possible directional-warhead configuration is shown in FIG. 5, where a mass-focused warhead is spun into position pyrotechnically in a few milliseconds (a proven technique). The aimable warhead, a structural member, is spun up by small tangential-thrust rocket motors after the turret bearings holding it in place are explosively unlocked. Two, three and four-sided configurations are also feasible to trade off aiming lag time. To minimize warhead steering energy requirements and stresses, it should be noted that a rough indication of miss direction may be available from the seeker up to a quarter second before intercept, with final aiming controlled by the fuze over the last 10–15 milliseconds. A warhead gain of 4 over same-length planar warheads is achievable. Simulation involving target vulnerabilities and fuzing errors point to optimum directional warhead beams of some 20 degrees square. Electronic steering by selected nets of detonators is faster but probably results in lower gains.

Variants

While the above discussion has centered on air targets, and non-spinning or slowly-spinning missiles, other targets and carriers are of interest. For example, the imaging fuze, with appropriate algorithms fed into the microprocessor, may be used against surface targets by missiles, rockets, projectiles or bombs. Other variants may be discerned from the parent application hereof (Ser. No. 08/560,132 filed Nov. 17, 1995) now U.S. Pat. No. 5,669,581 issued on Sep. 23, 1997, the content of which is hereby incorporated herein by reference and made a part hereof.

Having thus described a preferred embodiment of the invention, it being understood that the disclosure is only illustrative and may not be deemed to limit the scope of protection hereof, what is claimed is:

1. In a substantially non-spinning guided missile, a passive-infrared-imaging fuze comprising at least one set of body-fixed wide-angle optics providing at least forward hemisphere coverage, a multi-element detector array and a microprocessor for image and data processing, aim-point selection and fuzing; and further comprising a safety-and-arming device and a non-aimable warhead.

2. In a substantially non-spinning guided missile, a passive-infrared-imaging fuze comprising at least one set of body-fixed wide-angle optics providing at least forward hemisphere coverage, a multi-element detector array and a microprocessor for image and data processing, aim-point selection and fuzing wherein said fuzing is skewed cone fuzing; and further comprising a safety-and-arming device and a non-aimable warhead.

3. In a substantially non-spinning guided missile, a passive-infrared-imaging fuze comprising at least one set of body-fixed wide-angle optics providing at least forward hemisphere coverage, a multi-element detector array and a microprocessor for image and data processing, aim-point selection and fuzing wherein said fuzing is skewed cone fuzing and wherein said skewed cone has a generatrix which is the vector sum of missile velocity, warhead velocity and the negative of target velocity; and further comprising a safety-and-arming device and a non-aimable warhead.

4. In a substantially non-spinning guided missile, a passive-infrared-imaging fuze comprising at least one set of body-fixed wide-angle optics providing at least forward hemisphere coverage, a multi-element detector array and a microprocessor for image and data processing, aim-point selection and fuzing; and further comprising a safety-and-arming device and a warhead having two-dimensional directionality in a selected direction, said warhead being aimable; and means for miss direction prediction and directional-warhead aiming.

5. In a substantially non-spinning rocket, a passive-infrared-imaging fuze comprising at least one set of body-fixed wide-angle optics providing at least forward hemisphere coverage, a multi-element detector array and a microprocessor for image and data processing, aim-point selection and fuzing;

further comprising a safety-and-arming device and a non-aimable warhead.

6. In a substantially non-spinning rocket, a passive-infrared-imaging fuze comprising at least one set of body-fixed wide-angle optics providing at least forward hemisphere coverage, a multi-element detector array and a microprocessor for image and data processing, aim-point selection and fuzing wherein said fuzing is skewed cone fuzing; and further comprising a safety-and-arming device and a non-aimable warhead.

7. In a substantially non-spinning rocket, a passive-infrared-imaging fuze comprising at least one set of body-fixed wide-angle optics providing at least forward hemisphere coverage, a multi-element detector array and a microprocessor for image and data processing, aim-point selection and fuzing wherein said fuzing is skewed cone fuzing and wherein said skewed cone has a generatrix which is the vector sum of rocket velocity, warhead velocity and the negative of target velocity; and further comprising a safety-and-arming device and a non-aimable warhead.

8. In a substantially non-spinning rocket, a passive-infrared-imaging fuze comprising at least one set of body-fixed wide-angle optics providing at least forward hemisphere coverage, a multi-element detector array and a microprocessor for image and data processing, aim-point selection and fuzing; and further comprising a safety-and-aiming device and a warhead having, two-dimensional directionality in a selected direction, said warhead being aimable; and means for miss distance prediction and directional-warhead aiming.

9. In a substantially non-spinning bomb, a passive-infrared-imaging fuze comprising at least one set of body-fixed wide-angle optics providing forward hemisphere coverage, a multi-element detector array and a microprocessor for image and data processing, aim-point selection and fuzing;

further comprising a safety-and-arming device and a non-aimable warhead.

10. In a substantially non-spinning bomb, a passive-infrared-imaging fuze comprising at least one set of body-fixed wide-angle optics providing forward hemisphere coverage, a multi-element detector array and a microprocessor for image and data processing, aim-point selection and fuzing wherein said fuzing is skewed cone fuzing; and further comprising a safety-and-arming device and a non-aimable warhead.

11. In a substantially non-spinning bomb, a passive-infrared-imaging fuze comprising at least one set of body-fixed wide-angle optics providing forward hemisphere coverage, a multi-element detector array and a microprocessor for image and data processing, aim-point selection and fuzing wherein said fuzing is skewed cone fuzing and wherein said skewed cone has a generatrix which is the vector sum of bomb velocity, warhead velocity and the negative of target velocity; and further comprising a safety-and-arming device and a non-aimable warhead.

12. In a substantially non-spinning bomb, a passive-infrared-imaging fuze comprising at least one set of body-fixed wide-angle optics providing forward hemisphere coverage, a multi-element detector array and a microprocessor for image and data processing, aim-point selection and fuzing;

further comprising a safety-and-aiming device and a warhead having, two-dimensional directionality in a selected direction, said warhead being aimable; and means for miss direction prediction and directional-warhead aiming.

13. In a substantially non-spinning projectile, a passive-infrared-imaging fuze comprising at least one set of body-fixed wide-angle optics providing forward hemisphere coverage, a multi-element detector array and a microprocessor for image and data processing, aim-point selection and fuzing;

further comprising a safety-and-arming device and a non-aimable warhead.

14. In a substantially non-spinning projectile, a passive-infrared-imaging fuze comprising at least one set of body-fixed wide-angle optics providing forward hemisphere coverage, a multi-element detector array and a microprocessor for image and data processing, aim-point selection and fuzing;

further comprising a safety-and-aiming device and a warhead having two-dimensional directionality in a selected direction, said warhead being aimable; and means for miss direction prediction and directional-warhead aiming.

* * * * *